US010759021B2

(12) United States Patent
Myers

(10) Patent No.: US 10,759,021 B2
(45) Date of Patent: Sep. 1, 2020

(54) HOOD FOR DRUM SANDER

(71) Applicant: JPW Industries Inc., La Vergne, TN (US)

(72) Inventor: Steven Myers, Buffalo Valley, TN (US)

(73) Assignee: JPW Industries Inc., LaVergne, TN (US)

( * ) Notice: Subject to any disclaimer, the term of this patent is extended or adjusted under 35 U.S.C. 154(b) by 288 days.

(21) Appl. No.: 15/645,356

(22) Filed: Jul. 10, 2017

(65) Prior Publication Data

US 2018/0369986 A1 Dec. 27, 2018

Related U.S. Application Data

(63) Continuation of application No. 29/608,768, filed on Jun. 26, 2017.

(51) Int. Cl.

| | |
|---|---|
| ***B24B 55/00*** | (2006.01) |
| ***B24B 55/06*** | (2006.01) |
| ***B24B 55/04*** | (2006.01) |
| ***B24D 9/00*** | (2006.01) |
| *B24B 55/05* | (2006.01) |

(52) U.S. Cl.

CPC ..... *B24B 55/06* (2013.01); *B24B 55/04* (2013.01); *B24D 9/006* (2013.01); *B24B 55/05* (2013.01)

(58) Field of Classification Search

CPC ..... A47L 9/06; A47L 9/0606; A47L 9/0613; B23D 59/00; B23D 59/006; B23Q 11/08; B24B 55/04; B24B 55/05; B24B 55/052; B24B 55/06; B24B 55/102

USPC ..... 451/67

See application file for complete search history.

(56) References Cited

U.S. PATENT DOCUMENTS

| | | | | | |
|---|---|---|---|---|---|
| 790,943 | A * | 5/1905 | Weber | B24B 55/06 | 144/252.1 |
| 2,229,598 | A * | 1/1941 | Nash | B24B 27/0015 | 144/252.1 |
| 2,745,230 | A * | 5/1956 | Krogsgaard | B24B 55/04 | 451/453 |
| 3,455,066 | A * | 7/1969 | Estabrook | B24B 21/12 | 451/300 |
| 3,603,041 | A * | 9/1971 | McDonald | B24B 21/12 | 451/300 |
| 3,673,744 | A * | 7/1972 | Oimoen | B24B 55/102 | 451/353 |
| 3,808,749 | A * | 5/1974 | Rosberg | B24B 55/04 | 451/452 |
| 3,946,861 | A * | 3/1976 | Sandefur | B65G 23/44 | 198/810.04 |

(Continued)

*Primary Examiner* — George B Nguyen

(74) *Attorney, Agent, or Firm* — Waller Lansden Dortch & Davis, LLP; Blake M. Bernard

(57) ABSTRACT

A drum sander having a fin for deflecting airflow around the drum and directing dust and debris to a dust collecting outlet. The fin includes a first section at a first angle and a second section at a second angle that directs air movement generated by the operating drum toward the dust collecting outlet. The free edge of the fin is shaped to wrap partially around the drum in two helical inclined planes. A tool free adjustment of parallelism may be provided. The workpieces are pulled through the sander rather than being pushed through. Lightweight materials reduce stress on the assembly. Heat is dissipated by the configuration and material of the drum.

10 Claims, 6 Drawing Sheets

(56) References Cited

U.S. PATENT DOCUMENTS

| | | | | | |
|---|---|---|---|---|---|
| 4,192,104 | A * | 3/1980 | Patenaude | B24B 55/06 | 144/252.1 |
| 4,615,146 | A * | 10/1986 | Tassoni | B27M 1/003 | 451/211 |
| 5,033,192 | A * | 7/1991 | Franz | B23D 59/006 | 30/124 |
| 5,125,190 | A * | 6/1992 | Buser | B24B 55/102 | 451/359 |
| 5,791,979 | A * | 8/1998 | Duncan | B24B 55/102 | 451/359 |
| 6,431,969 | B1 * | 8/2002 | Sauter | B24B 19/18 | 451/184 |
| 6,503,125 | B1 * | 1/2003 | Harrington | B24B 55/06 | 451/28 |
| 6,896,605 | B2 * | 5/2005 | Ohlendorf | B24B 23/02 | 451/359 |
| 6,899,606 | B2 * | 5/2005 | Liao | B24B 7/06 | 198/813 |
| 7,037,181 | B1 * | 5/2006 | Faas | B24B 3/60 | 451/184 |
| 8,764,520 | B1 * | 7/2014 | Fields | B24B 55/102 | 15/347 |
| D818,506 | S * | 5/2018 | Myers | B24B 55/06 | D15/138 |
| 2010/0144251 | A1 * | 6/2010 | Farrell | B24B 23/02 | 451/358 |
| 2015/0239091 | A1 * | 8/2015 | Piliguian | B24B 41/02 | 451/41 |

* cited by examiner 10
65
66
60
18
64
56
62
37
54
52
50
40
54
6
68
74
44
5
6
70
72
34
5
20
42
58
33
14
46
48
30
30a
31a
31b
32
12
22
35
39
36
16
24
22
28
38
26
24
26
22
24

HOOD FOR DRUM SANDER

CROSS-REFERENCE TO RELATED APPLICATION

This application claims the benefit of U.S. Design patent application Ser. No. 29/608,768, filed Jun. 26, 2017, which is incorporated herein by reference.

BACKGROUND OF THE INVENTION

Field of the Invention

The present invention relates generally to a power tool and more particularly to a housing for a power tool.

Description of the Related Art

Power tools, such as saws, sanders, drills, and the like, generate debris in the form of dust, chips, and particulates, from the material being worked. The debris may be referred to as sawdust in some instances. It is beneficial to collect the debris as it is being generated using a dust collecting system rather than let is accumulate at the tool or become airborne. Dust collectors are available for both large workshops as well as for small shops or work areas, including for home workshops. The dust collectors may include vacuum and filtration systems that are connected by hoses to duct collecting ports on the power tools. The efficiency of the dust collecting system may depend on the configuration of the power tool.

SUMMARY OF THE INVENTION

The present invention provides a hood for a power tool and provides a power tool that includes a hood for collecting dust generated during operation of the power tool. The hood encloses a portion of the working element of the power tool and includes an outlet port to which a dust collector is connected. The hood includes one or more fins directed toward the working element and shaped to conform to a contour of the working element. The one or more fins may extend within the hood to deflect and direct dust and particles from the working element toward the outlet port.

DETAILED DESCRIPTION OF THE PREFERRED EMBODIMENTS

Figure 1:
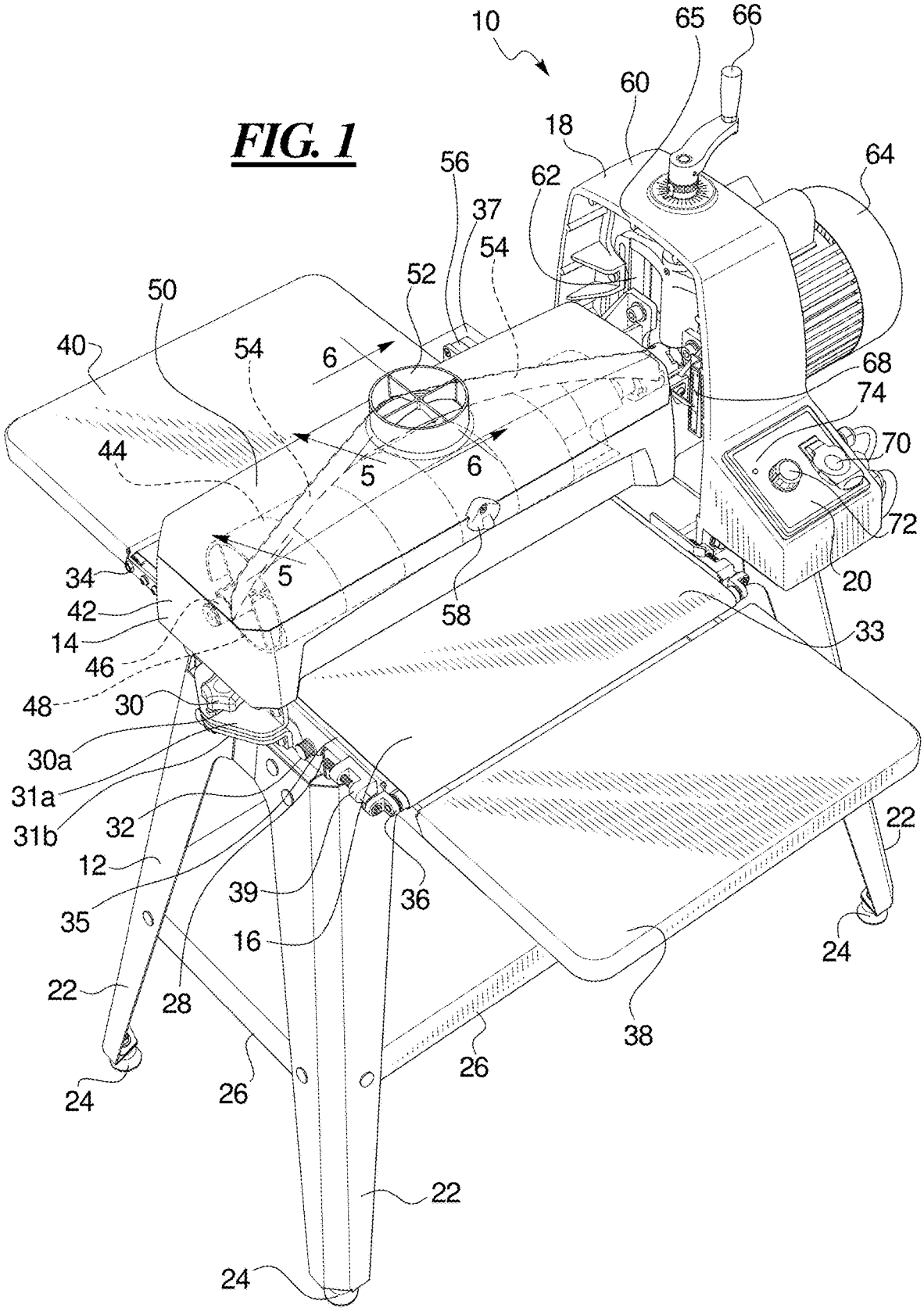
FIG. 1 is an perspective view from the front, top, left side of a drum sander.

In FIG. 1 is shown a drum sander 10 mounted on a stand 12. The drum sander 10 includes a drum carriage 14 that is positioned above a take-up conveyor 16. The spacing between the drum carriage 14 and the take-up conveyor 16 is adjustable by adjusting a drum and motor support 18. Operation of the drum sander 10 is controlled at a control panel 20.

In particular, the stand 12 includes four legs 22 at the lower end of which are adjustable feet 24 for leveling the drum sander 10 and/or accommodating an uneven floor. A shelf 26 extends between the legs 22. Instead of the illustrated stand, the drum sander 10 may be mounted on a cabinet, workbench, counter or other location. For example, the drum sander 10 may be mounted on a cabinet having shelves, doors, drawers, or the like. An upper portion of the stand 12 supports a table 28 on which the take-up conveyor 16 is mounted.

An alignment knob 30 is connected to a vertically disposed threaded adjustment screw 30*a* that extends between a top parallel adjustment flange 31*a* that extends from the take-up conveyor 16 and a bottom parallel adjustment flange 31*b* that extends from the table 28. As the alignment knob 30 is rotated, the adjustment screw 30*a* rotates in a threaded nut or bore to change the distance between the top parallel adjustment flange 31*a* and the bottom parallel adjustment flange 31*b*. The parallel adjustment flanges 31*a* and 31*b* are connected to the outside edges of the take-up conveyor 16 and the table 28. By rotating the alignment knob 30, the tilt angle of the take-up conveyor 16 relative to the table 28 is changed, which changes the tilt angle of the take-up conveyor 16 relative to the drum carriage 14. The user may rotate the alignment knob 30 to adjust the parallelism between the sanding drum and the take-up conveyor 16. For workpieces that are narrower than the length of the sanding drum, the drum and conveyor are commonly maintained in a parallel position although other positions are possible. Adjustment of the conveyor 16 to an out-of-parallel position permits the sanding of workpieces that are wider than the length of the drum by sanding each side at an angle so that the surface of the workpiece is slightly higher in the middle of the workpiece and lower at the edges. The present parallelism adjustment is performed without tools by rotating the hand adjustable alignment knob 30 to the desired position. In certain embodiments, a detent, clicker, stop or other indicator interacts between the parallel adjustment flange and the alignment knob 30 or on the adjustment screw 30*a* to provide an audible, physical or haptic indicator to the user when the conveyor 16 has been moved to the parallel position. The user may quickly and easily return the tool to a parallel position.

A table locking screw 32 is shown for fastening the table 28 to the stand 12. Several table locking screws 32 may be provided at positions around the table 28 to hold the drum sander 10 to the stand 12.

The take-up conveyor 16 includes a conveyor belt 33 that supports workpieces and moves them beneath the drum carriage 14. The workpieces may be pieces of wood or other material to be sanded, smoothed, shaped or otherwise worked by the drum sander. The conveyor belt 33 is supported by a conveyor support plate 35 at its middle extent and is movable on a drive roller 34 and a driven roller 36. The drive roller 34 is at the outlet side of the drum sander 10 so that workpieces are pulled through the sander as opposed to being pushed through the sander by a driven roller at the input side. The drive roller 34 is connected to a belt drive motor 37 which operates to move the conveyor belt 33 on the rollers 34 and 36. The belt drive motor 37 may be controlled to vary the speed of the conveyor belt 33 automatically or manually. The spacing between the drive roller 34 and the driven roller 36 may be adjusted to adjust the tension on and alignment of the belt 33. For example, a belt tension adjuster 39 is provided at both edges of the conveyor support plate 35 and is operable by a wrench or other tool to adjust the tension and alignment of the belt 33 on the rollers 34 and 36. The spacing between the conveyor support plate 35 and the driven roller 36 is adjustable by the belt tension adjuster 39.

The illustrated embodiment includes an infeed table 38 and an outfeed table 40 that are mounted to the stand 12 or the table 28 and extend in the plane of the take-up conveyor to support processing of longer workpieces. The infeed table 38 and outfeed table 40 may be added or removed as needed.

The drum carriage 14 includes a frame 42 which supports a drum 44. The drum 44 is mounted on an axle 46, the axle 46 being mounted for rotation in bearings 48 affixed to the frame 42. A hood 50 is mounted on the frame 42 above the drum 44. The hood 50 includes a dust collecting port 52 to which may be connected a pipe or hose of a dust collector, such as a vacuum dust collector, which operates to draw air through the dust collecting port 52 for collecting any dust or debris generated by the operation of the drum sander. On the inside surface of the hood 50 are a pair of fins 54 that are angled to direct dust generated by the sanding operation of the drum sander 10 to the dust collecting port 52. The hood 50 is fastened to the frame 42 by a pair of hinges 56, one of which is visible in this view, along a back edge of the hood 50 so that the hood 50 may be pivoted to provide access to the drum 44, such as for changing the abrasive paper on the drum 44. A latch 58 on the front edge of the hood 50 secures the hood 50 in a closed position, such as during operation of the drum sander. The latch 58 is releasable by the user to that the drum 44 can be inspected, the abrasive media changed, the bearings inspected, or other operations or maintenance performed.

The drum carriage 14 is held by the drum and motor support 18. The drum and motor support includes a shroud 60 that encloses a motor mount slide 62 to which is attached a motor 64 and the drum carriage. The motor 64 may be a 1½ HP electric motor in certain examples, although other motors may be provided instead. The motor mount slide 62 may be moved vertically within the shroud 60 to adjust the spacing between the take-up conveyor 16 and the drum 44 to accommodate different thicknesses of workpieces. The vertical movement of the drum carriage 14 may be provided by a threaded height adjustment lead screw 65 on which the motor mount slide 62 is mounted. The height adjustment lead screw 65 is rotated using a drum height adjustment handle 66 that provides a crank mounted in the top of the shroud 60 for rotating the vertically disposed lead screw 65. A depth indicator 68 is mounted on the shroud 60 and an indicator arrow extends from the motor mount slide 62 to indicate a distance between the take-up conveyor 16 and the drum 44 corresponding to the depth of the workpiece to be sanded or otherwise worked.

The body of the drum sander 10 may be of die cast aluminum in certain embodiments. The aluminum body weighs less than steel or other materials that may be used, reducing the stress on the cantilevered components.

The control panel 20 extends from the shroud 18 and includes an on/off switch 70 by which the operation of the motor 64 may be controlled. In certain embodiments, a safety key is provided for the on/off switch, for example, to prevent inadvertent operation of the motor 64. A feed rate controller 72 includes a dial by which the feed rate of workpieces below the drum 44 may be controlled. The feed rate controller 72 may sense the rotating speed of the drum 44 and/or the load on the motor 64 as the workpiece is moved by the take-up conveyor 16. When the load on the motor 64 increases above a level set by the user via the dial, the feed rate of the workpiece by the take-up conveyor is reduced. Reduction of the load on the motor 64 may result in the feed rate being increased, at least to a predetermined feed rate. Different materials have different resistance to being worked, such as softer woods or harder woods or differences in grain in the wood or the presence of knots, for example. The feed rate controller 72 may accommodate such differences. An indicator light 74 may be provided to indicate a feed rate setting that is too fast or a depth of cut setting that is too great for the material being worked by illumination of the indicator light. Other features of the drum sander 10 may be provided as will be understood by those of skill in the art.

The features and improvements disclosed herein may be provided on an abrading machine, a cutting machine, a drilling machine, a turning machine, a rotating machine or other machine and are not limited to a drum sander. Examples of machines on which the hood according to the present invention may be provided include a drum sander, belt sander, disk sander, stroke sander, oscillating sander, grinder, saw, drill, planer, polisher, router, lathe, tenoner, milling machine, boring machine, etc.

Figure 2:
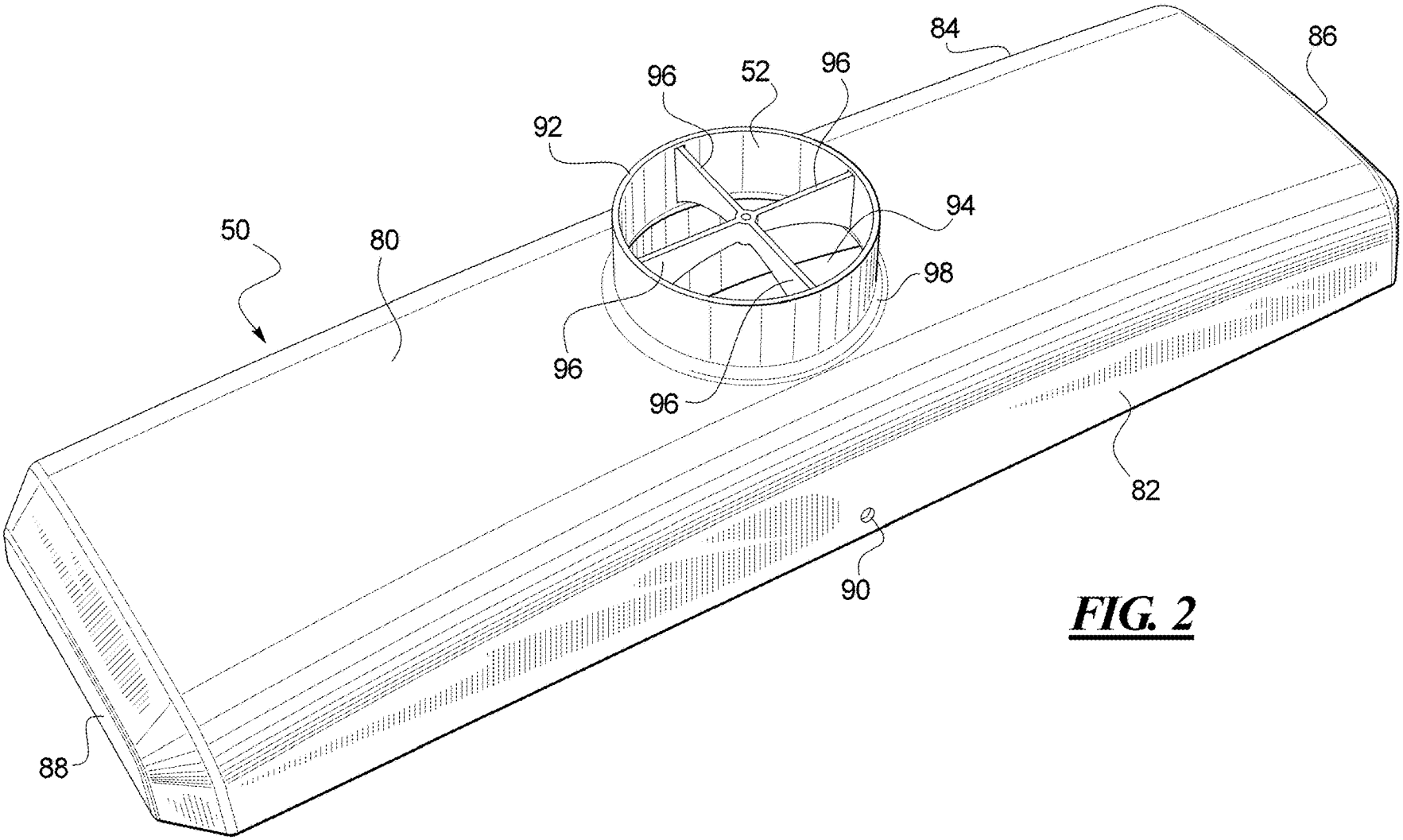
FIG. 2 is a perspective view from the front, top, left side of exterior of the hood of the drum sander of FIG. 1.

Turning to FIG. 2, the hood 50 has an overall rectangular shape with a top surface 80, a front surface 82, a back surface 84, and opposite end surfaces 86 and 88. The top surface 80 may be curved and the edges between the top, front, back and end surfaces may be rounded, beveled, or otherwise shaped. The front surface 82 includes a hole 90 at which the latch 58 may be attached.

The dust collecting port 52 includes a cylindrical flange 92 about a circular opening 94 through the top surface 80 of the hood 50. Support struts 96 extend from an inside surface of the cylindrical flange 92 and cross within the cylindrical interior space of the cylindrical flange 92. Four such struts 96 are provided evenly spaced within the cylindrical flange 92, the struts 96 being connected to one another at a center of the cylindrical interior space. The struts 96 have straight top edges and curved bottom edges. The struts 96 reinforce the cylindrical flange 96 against the forces that might be exerted by a hose clamp, for example, for clamping a hose of a dust collector onto the flange 96. Other numbers or shapes of struts or other means for reinforcing the flange 96 may be provided within the scope of this invention. In the illustrated embodiment, a collar 98 is provided at the base of the cylindrical flange 96 where it joins the top surface 80. The collar 98 may provide a reinforced connection between the flange 96 and the top surface 80.

Figure 3:
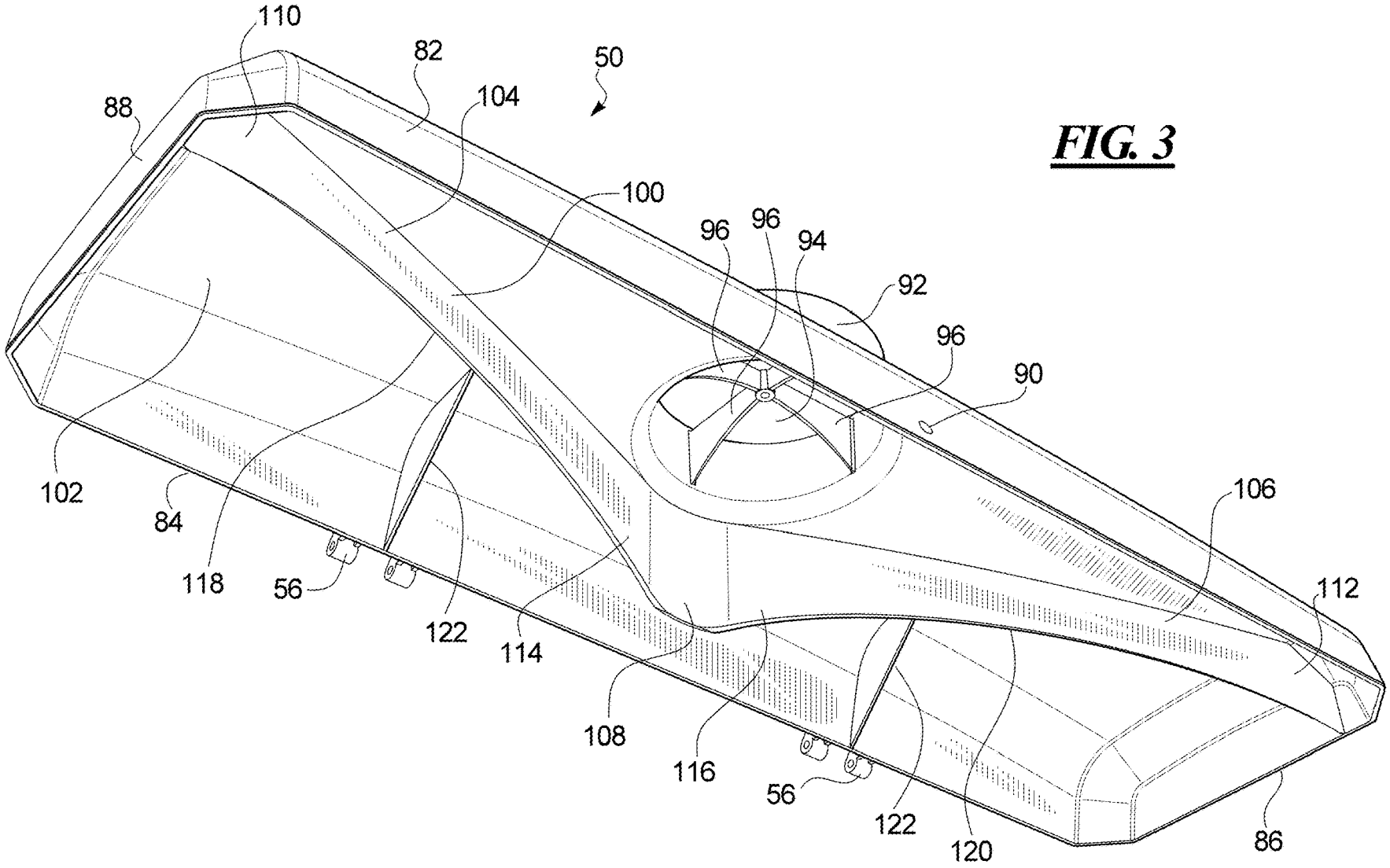
FIG. 3 is a perspective view from the front, bottom, left side of the interior of the hood.

In FIG. 3, the inside of the hood 50 includes a fin 100 that extends from an inside top surface 102. In certain embodiments, the fin 100 extends perpendicular to a plane that defines an overall shape of the top surface 102, ignoring local curvature of the top surface 102. The fin 100 includes a first fin section 104 that extends from the end 88 to the circular opening 94 and a second fin section 106 that extends from the opposite end 86 to the circular opening 94. A tangent fin section 108 is connected between the first fin section 104 and the second fin section 106 and is disposed generally along a tangent or portion of a perimeter of the circular opening 94. The fin sections 104 and 106 not only extend from side to side in the hood 50 but also extend from front to back. In particular, an outside end 110 of the first fin section 104 at the end surface 88 is adjacent the front surface 80 and an outside end 112 of the second fin section 106 at the end surface 86 is adjacent the front surface 80. An inside end 114 of the first fin section 104 and an inside end 116 of the second fin section 106 at the circular opening 94 are adjacent the back surface 84. The first and second fin sections 104 and 106 each extend diagonally within the hood 50 in opposite directions so that the fin 100 has an chevron shape or a V shape.

The height of the fin 100 from the inside surface 102 changes along its length in certain embodiments. In particular, the fin 100 extends a greater distance from the inside surface 102 at the outside end 110 and the outside end 112 as well as at the inside end 114 and the inside end 116. The fin 100 extends a lesser distance from the inside surface 102 at a middle portion 118 of the first fin section 104 and at a middle portion 120 of the second fin section 106. The difference in the height of the fin 100 from the inside surface 102 may depend on the shaped of the inside surface 102. For example, a more cylindrical inside surface 102 may result in less difference in the height of the fin along its length, or even no difference.

The free edge of the fin 100 is curved generally in a first arc from the outside end 110 to the middle portion 118 and to the inside end 114, in other words along the first fin portion 104, and in a second arc from the outside end 112 to the middle portion 120 and to the inside end 116, in other words along the second fin portion 106. The free edges of the first fin portion 104 and the second fin portion 106 may be curved. The first fin portion 104 and the second fin portion 106 may extend in a straight line or may be curved or otherwise shaped as desired.

The inside of the hood 50 includes gussets 122. The gussets 122 extend between the inside top surface 102 and the back surface 84. In the illustrated embodiment, one gusset 122 is provided at each of the hinges 56. The gussets 122 strengthen the hood 50 at the hinges 56.

Figure 4:
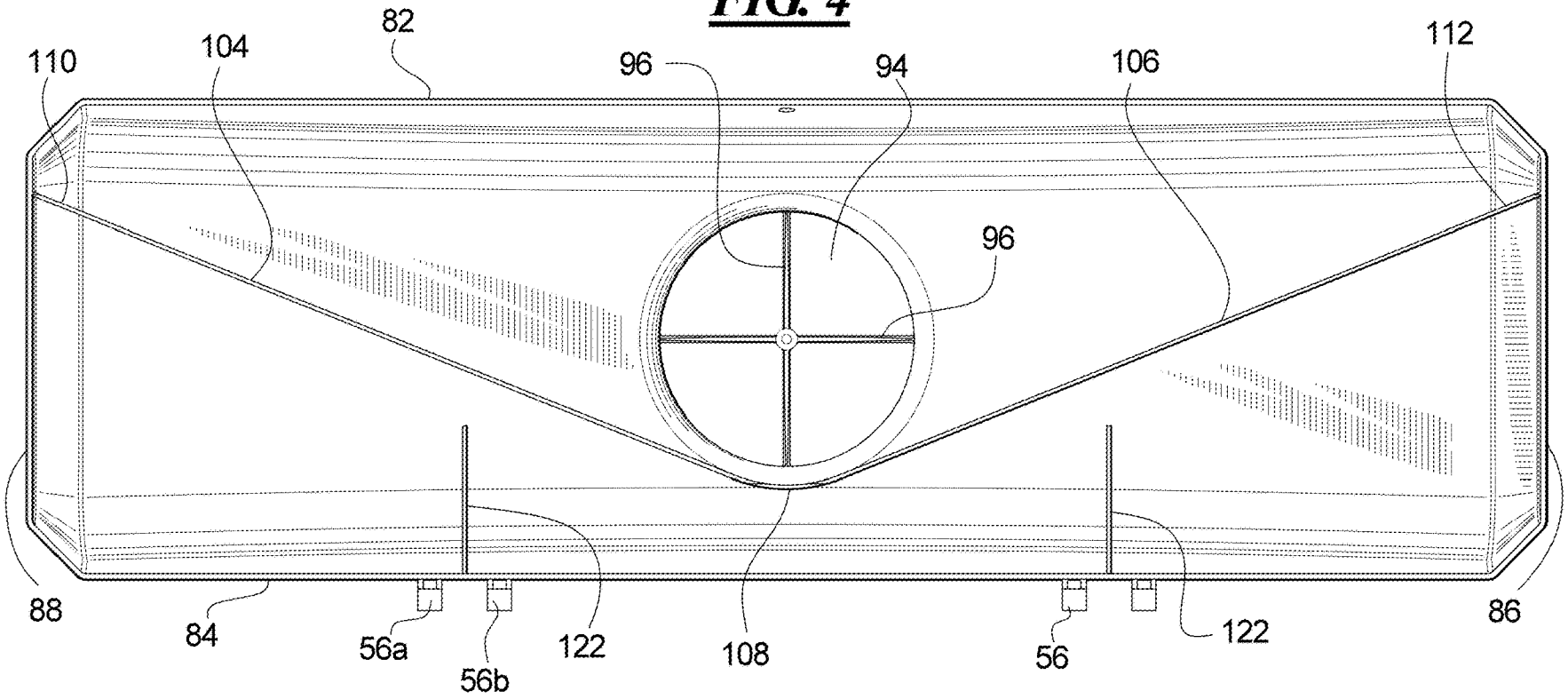
FIG. 4 is a bottom plan view of the hood.

A bottom view of the hood 50 is provided in FIG. 4, wherein the V shape or chevron shape of the fin 100 is apparent. The first fin portion 104 extends to the end surface 88 at its outside end 110 and the second fin portion 106 extends to the end surface 86 at its outside end 112. The distance traversed by the fin 100 from front to back of the hood 50 is approximately equal to the diameter of the opening 94 in certain embodiments. The side-to-side extent of the fin 100 is the full length of the hood 50. The V-shaped fin 100 directs sawdust and debris from the full length of the hood 50 toward the opening 94 of the dust collecting port 52. In certain embodiments, the V-shaped fin 100 extends the full length of the drum 44 for directing sawdust and debris along the full length of the drum 44.

The hinges 56 of the illustrated embodiment includes each include two hinge parts or hinge knuckles 56*a* and 56*b* that fit onto cooperating hinge parts on the frame 42 and that receive a hinge pin around which the hinge parts pivot.

The dust collecting opening 94 is located at the center of the hood 50 in certain embodiments. Alternative embodiments may locate the dust collecting opening at a location other than the center. For example, the dust collecting opening may be located adjacent or at an end of the hood or at another location. The fins of such alternative embodiments may be shaped and positioned to direct dust toward the dust collecting opening.

Figure 5:
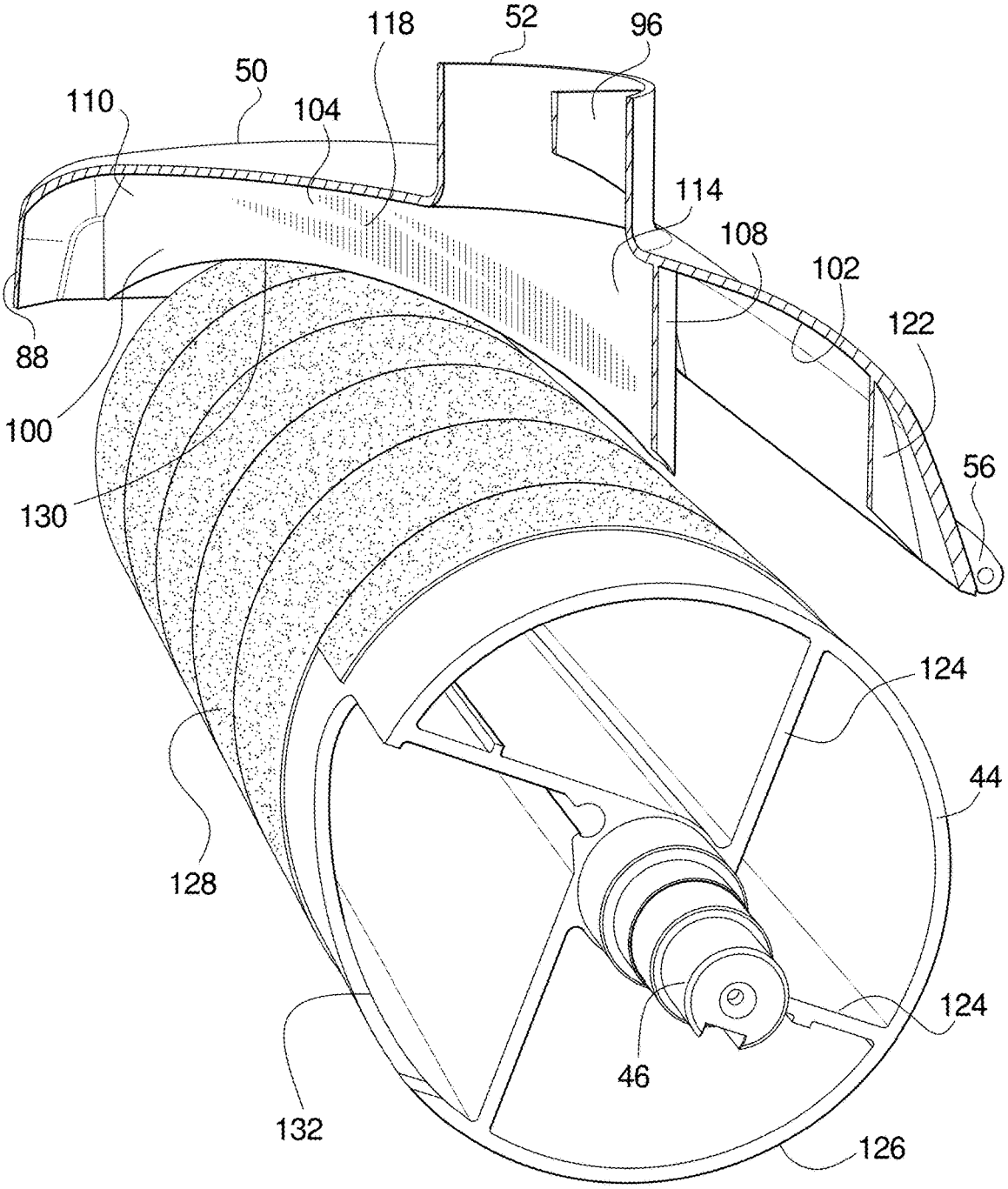
FIG. 5 is a partial cross-sectional view along a diagonal line through the hood showing a fin of the hood adjacent the drum of the drum sander.

FIG. 5 shows the relationship between the drum 44 of the drum sander 10 and the hood 50 when the hood is in the closed position for operation of the drum sander 10. The drum 44 rotates about the axle 46 by operation of the motor 64 which drives the axle 46. The rotating motion is transferred from the axle 46 through spokes 124 to a drum cylinder 126. An abrasive 128 such as sandpaper is mounted on the drum cylinder 126. In certain embodiments, the abrasive is a length of sandpaper that has been wrapped in a spiral around the drum cylinder 126 to cover the surface of the drum cylinder 126. For example, a sandpaper strip 128 may be spiral wrapped in touching wraps onto the drum cylinder 126. The ends of the sandpaper strip 128 may be held in clips or otherwise fastened onto the drum 44.

The hood 50 is shown in cross section along a portion of the fin 100 in FIG. 5. In particular, the fin 100 has the outside end 110 extending a greater distance from the inside top surface 102, the middle portion 118 extending a lesser distance from the surface 102, and the inside end 114 of the fin extending a greater distance from the surface 102. The fin 100 has a free edge 130 that is curved. The curved free edge 130 wraps part of the way around the drum 44. The curved free edge 130 of the fin 100 maintains a close spacing of the edge to the drum surface along the length of the first fin section 104. A similar shape for the second fin section 106 results in the second fin section being in close proximity to the cylindrical shaped of the drum along the length of the fin section 106.

The free edge 130 of the first fin section 104 of certain embodiments lies in a first helical inclined plane rotating in a first direction and the free edge 130 of the second fin section 106 lies in a helical inclined plane rotating in a second direction.

A cut out 132 may be provided in the drum 44 at which an end of the abrasive sandpaper strip may be fastened. A fastener for the abrasive 128 may be provided at the cutout 132. In certain embodiments, a tool-less take-up clip is provided at the cut out 132 to hold the end of the sandpaper strip to the drum 44.

The drum 44 of certain embodiments is of extruded material and is shaped to dissipate heat that is generated during the sanding operation. In certain embodiments the drum may be 16 inches in length, providing up to 16 inches of sanding in a single pass or 32 inches of sanding in a double pass. In certain other embodiments, the drum is 18 inches in length, providing an 18 inch single pass or 36 inch double pass sanding width.

Figure 6:
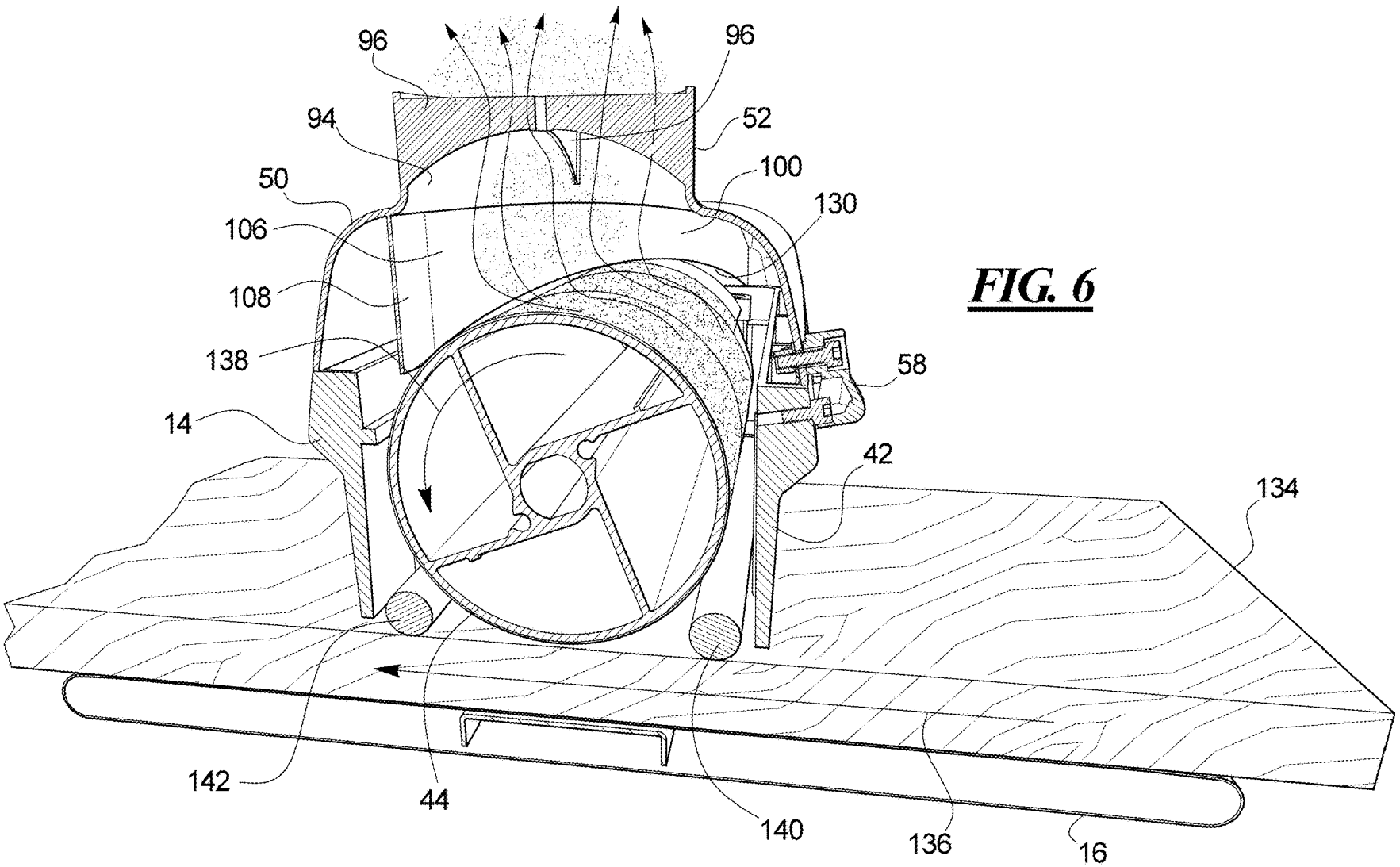
FIG. 6 is a cross-sectional view along a transverse line through the drum sander showing a workpiece being worked by the drum sander.

With reference to FIG. 6, a workpiece 134, shown here as a wooden board, is resting on the take-up conveyor 16. The take-up conveyor 16 operates to more the workpiece 134 in the direction of linear arrow 136. The drum 44 is driven by the motor 64 to rotate in the direction of arcuate arrow 138. The drum carriage 14 is positioned to bring the drum 44 into contact with the workpiece 134. As the workpiece 134 moves under the drum 44 under control of the take-up conveyor 16, the abrasive 128 on the surface of the drum 44 abrades the surface of the workpiece 134. The abrading action removes any irregularities such as saw marks from the surface of the workpiece 134 and, depending on the grit size of the abrasive, smooths the surface and/or thins the workpiece.

Rotation of the drum 44 not only abrades the workpiece 134 but also results in a layer of air around the drum being carried along with the rotating drum 44. Material removed from the workpiece by the abrading action of the abrasive may become airborne and be carried in the moving air. Airborne sawdust and sanding dust generated at the center of the sanding drum is carried under the circular opening 94 in the hood 50 by the rotation of the drum 44 and is removed from the drum sander 10 by the vacuum operation of the dust collector. Airborne sawdust and sanding dust generated at portions of the drum sander spaced from the center of the drum, including at the ends of the sanding drum are carried in the air around the drum until the air and dust stream encounters the fin 100. The fin 100 extends in close proximity to the surface of the drum 44 to block the continued rotation of dust and air around the drum. The fin sections 104 and 106 are disposed at an angle so that the combined effect of the fin angle, the air carried along with the rotating drum, and the vacuum of the dust collector directs the air and dust from the full length of the drum 44 to the dust collecting port 52. The curved free edge of the fin 100 is provided at a relatively constant spacing from the surface of the drum 44 to ensure that air along the full length of the drum 44 is directed toward the dust collecting port 52. The increased height of the fin 100 at the outer ends ensures that dust is channeled to the dust collecting port 52 from the ends of the drum 44. The increased height of the fin 100 at the center of the fin 100 or tangent fin section 108 ensures that the higher concentration of dust that has been channeled toward the center of the drum is caught-up in the air stream and removed.

The fin 100 is shaped and positioned so that the curved free edge 130 directs air and sanding dust from the full length of the drum 44 toward the dust collecting port 52. Sanding dust, sawdust, and particles entrained in the air are blocked from being carried around the drum 44 by the fin 100 so that the air entrained particles are removed from the drum sander 10. The angled fin sections 104 and 106 and the curved free edge 130 catch and direct the air being moved by the rotating drum 44 to direct the sawdust and sanding dust from all parts of the drum to the outlet.

The operation of the drum sander 10 provides the possibility that sanding dust and debris will be generated along the entire length of the drum, for example if a wide workpiece is being sanded. Thus, the fin 100 extends along the full length of the dust and debris generating portion of the drum 44. Operation of the drum sander 10 generates air flow around the drum 44 in the rotating direction of the drum 44. Thus, the fin 100 is angled relative to the air flow direction to use the drum generated air flow to direct the dust and debris toward the dust collecting outlet. The drum is cylindrical. Thus, the fin 100 includes curved free edges that are shaped to conform to a shape of the working element or drum. In the present example, the fin edge is curved to extend around a portion of the circumference of the drum 44 so better collect the dust and debris from the cylindrical drum. While a single fin is shown, a plurality of fins may be provided, for example, in series or as parallel fins.

The principles shown herein may be applied to other material shaping machines, such as abrading, cutting, and drilling machines. The material shaping machine may be a rotating machine or reciprocating or vibrating machine. A hood for collecting debris of such material shaping machine may be provided with a dust collecting outlet and at least one fin to direct dust generated by the machine to the outlet. The at least one fin may extend along a dust or debris generating portion of the working tool, may be angled to deflect and direct Efficiency of the dust removal has increased significantly by hood as shown and described herein. In testing of an embodiment of the present hood, a 27 percent increase in dust collection was measured compared to drum sanders without the fin.

FIG. 6 shows rollers 140 and 142 at the lower portion of the frame 42. The roller 140 is an infeed tension roller and the roller 142 is an outfeed tension roller. The tension rollers 140 and 142 provide downward pressure on the workpiece and tension to counter to the moving direction of the workpiece. The tension by the rollers 140 and 142 may be separately adjusted to prevent snipe marks on the workpiece, which are linear marks across the width of the board.

Thus, there is shown and described a drum sander having a fin for deflecting airflow around the drum and directing dust and debris to a dust collecting outlet. A tool free adjustment of parallelism may be provided. The workpieces are pulled through the sander rather than being pushed through. Lightweight materials reduce stress on the assembly. Heat is dissipated by the configuration and material of the drum.

Although other modifications and changes may be suggested by those skilled in the art, it is the intention of the inventors to embody within the patent warranted hereon all changes and modifications as reasonably and properly come within the scope of their contribution to the art.

I claim:

1. A hood apparatus for a workpiece shaping machine having a working element for shaping a workpiece, the hood apparatus comprising:

a hood positionable to partially enclose the working element of the workpiece shaping machine, the hood defining a dust collecting opening configured for connection to a dust collector, the hood having an interior surface directed toward the working element when the hood partially encloses the working element of the workpiece shaping machine;

a fin extending from the interior surface of the hood toward the working element, the fin being shaped to redirect air moved by operation of the workpiece shaping machine toward the dust collecting opening;

wherein the working element is a cylindrical working element having a rotational axis, and the fin includes a first fin section extending along a first angle relative to the rotational axis of the working element and a second fin section extending along a second angle relative to the rotational axis of the working element when the hood partially encloses the working element; and wherein the fin further comprises a tangential fin section connected between the first and second fin sections, the tangential fin section disposed along a portion of a perimeter of the dust collecting opening.

2. A hood apparatus as claimed in claim 1, wherein the fin extends along a full length of a working portion of the working element when the hood partially encloses the working element.

3. A hood apparatus as claimed in claim 1, wherein the working element is a rotating working element that generates an air flow direction during operation, and wherein the fin is disposed at an angle to the air flow direction and at an angle relative to an axis of the working element when the hood partially encloses the working element, the angle of the fin causing the fin to direct air and entrained dust toward the dust collecting opening.

4. A hood apparatus as claimed in claim 1, wherein the first and second fin sections extend toward opposite ends of the working element from the dust collecting opening when the hood partially encloses the working element.

5. A hood apparatus as claimed in claim 1, wherein the hood is configured for use on a drum sander.

6. A workpiece shaping machine, comprising:

a workpiece carriage;

a workpiece shaping tool mounted on the workpiece carriage;

a motor connected to the workpiece shaping tool and operable to drive the workpiece shaping tool;

a hood mounted on the workpiece carriage, the hood defining a dust collecting opening; and a fin extending from the hood toward the workpiece shaping tool, the fin being disposed at an angle relative to an axis of the workpiece shaping tool, the fin angle including a component in a direction of air movement as a result of operation of the workpiece shaping;

wherein the workpiece shaping tool is a cylindrical working element having a rotational axis, and the fin includes a first fin section extending along a first angle relative to the rotational axis of the working element and a second fin section extending along a second angle relative to the rotational axis of the working element when the hood partially encloses the working element; and wherein the fin further comprises a tangential fin section connected between the first and second fin sections, the tangential fin section disposed along a portion of a perimeter of the dust collecting opening.

7. A workpiece shaping machine as claimed in claim 6, wherein the fin include a first fin section extending along a first angle relative to an axis of the workpiece shaping tool and a second fin section extending along a second angle relative to an axis of the workpiece shaping tool.

8. A workpiece shaping machine as claimed in claim 6, wherein the workpiece shaping machine is a drum sander having a take-up conveyor;

wherein the workpiece shaping tool is a drum disposed opposite the take-up conveyor; and further comprising:

a parallel adjustment connected to the take-up conveyor to change an angle of the take-up conveyor relative to the drum.

9. A workpiece shaping machine as claimed in claim 8, wherein the take-up conveyor includes a conveyor bed, a drive roller and a driven roller connected to the conveyor bed, and a belt extending over the conveyor bed and the drive and driven rollers; further comprising:

a tension adjusting mechanism connected between the conveyor bed and one of the drive roller and driven roller, the tension adjusting mechanism being operable to vary a tension on the belt.

10. A workpiece shaping machine as claimed in claim 8, further comprising:

a belt drive motor connected to the drive roller, the drive roller being disposed at an output of the drum sander.

* * * * *